US012396566B2

(12) United States Patent
Petzold Sotomayor

(10) Patent No.: US 12,396,566 B2
(45) Date of Patent: Aug. 26, 2025

(54) PROTECTIVE, COLLAPSIBLE, LIGHTWEIGHT BED FINISHING FRAME

(71) Applicant: Heidi Pamela Petzold Sotomayor, Los Angeles, CA (US)

(72) Inventor: Heidi Pamela Petzold Sotomayor, Los Angeles, CA (US)

( * ) Notice: Subject to any disclaimer, the term of this patent is extended or adjusted under 35 U.S.C. 154(b) by 337 days.

(21) Appl. No.: 17/713,990

(22) Filed: Apr. 5, 2022

(65) Prior Publication Data

US 2022/0225783 A1 Jul. 21, 2022

Related U.S. Application Data

(63) Continuation of application No. 15/173,857, filed on Jun. 6, 2016, now Pat. No. 11,317,726.

(60) Provisional application No. 62/230,437, filed on Jun. 6, 2015.

(51) Int. Cl.
*A47C 19/02* (2006.01)

(52) U.S. Cl.
CPC ..... *A47C 19/02* (2013.01)

(58) Field of Classification Search
CPC ..... A47C 21/06; A47C 21/08; A47C 19/02; A47C 19/021; A47C 31/00; A47C 31/10; A47C 31/105; A47C 31/11; A47C 27/002; A47G 9/0284; A47G 9/0292; A47D 15/008
See application file for complete search history.

(56) References Cited

U.S. PATENT DOCUMENTS 113,605 A 4/1871 Willmot
1,699,498 A 1/1929 Hanauer
1,710,591 A 4/1929 Pingry
1,885,558 A * 11/1932 Smith ..... A47D 15/008 2/69.5
3,144,666 A * 8/1964 Ragsdale Mazera ..... A47G 9/0284 5/493
4,092,752 A 6/1978 Dougan
4,117,782 A 10/1978 Cahill
4,141,097 A * 2/1979 Levinsohn ..... A47G 9/0292 5/493
4,153,230 A 5/1979 Giacin
4,514,871 A 5/1985 Fisher et al.
4,873,734 A 10/1989 Pollard
5,021,279 A 6/1991 Whitener
5,027,454 A 7/1991 Peng
5,247,897 A 9/1993 Pepp
5,473,785 A 12/1995 Lager et al.
(Continued)

FOREIGN PATENT DOCUMENTS

FR 2976467 A1 * 12/2012 ..... A47C 27/086

OTHER PUBLICATIONS

FR-2976467-A1 Eng translation (Year: 2012).*

*Primary Examiner* — Justin C Mikowski
*Assistant Examiner* — Amanda L Bailey

(57) ABSTRACT

A protective, highly padded/cushioned, lightweight, collapsible, portable, affordable, and aesthetically pleasing bed finishing frame. The apparatus slips over a box spring without any assembly necessary, tangentially supporting generous padding/cushion around the perimeter of the box spring, thereby protecting individuals from injury by contacting any hard edges or surfaces associated with the box spring or bed frame and providing a stylistic and finished appearance.

17 Claims, 13 Drawing Sheets

(56) References Cited

U.S. PATENT DOCUMENTS

| | | | | |
|---|---|---|---|---|
| 5,496,609 | A | 3/1996 | Michelstein | |
| 5,508,078 | A | 4/1996 | Stalnaker | |
| 5,639,072 | A | 6/1997 | McCall | |
| 5,802,637 | A * | 9/1998 | Bordo | A47G 9/0292 5/663 |
| 6,076,212 | A | 6/2000 | Feld | |
| 6,708,941 | B1 | 3/2004 | Bowen et al. | |
| 6,848,130 | B1 | 2/2005 | Wilson | |
| 7,086,101 | B2 | 8/2006 | Welch et al. | |
| 7,904,977 | B1 | 3/2011 | Singh | |
| 2004/0049847 | A1 | 3/2004 | Leoutsakos | |
| 2005/0278858 | A1 | 12/2005 | Polevoy et al. | |
| 2006/0037146 | A1 | 2/2006 | Heng | |
| 2007/0017034 | A1 | 1/2007 | Creekmuir | |
| 2007/0090259 | A1 | 4/2007 | Chen et al. | |
| 2007/0234479 | A1 * | 10/2007 | Warshaver | A47C 31/105 5/690 |
| 2007/0283668 | A1 | 12/2007 | Oh | |
| 2008/0111043 | A1 | 5/2008 | Chen et al. | |
| 2008/0172799 | A1 | 7/2008 | Constantinescu et al. | |
| 2009/0200445 | A1 | 8/2009 | Benn | |
| 2009/0239005 | A1 | 9/2009 | Hawkins et al. | |
| 2010/0192299 | A1 | 8/2010 | Schermel et al. | |
| 2010/0287707 | A1 | 11/2010 | Beard et al. | |
| 2011/0127892 | A1 * | 6/2011 | Joachimmeyer | A47B 95/043 248/345.1 |
| 2011/0219540 | A1 | 9/2011 | Polevoy et al. | |
| 2012/0066835 | A1 * | 3/2012 | Kelly | A47G 9/0292 5/493 |
| 2013/0025051 | A1 | 1/2013 | Syrowitz et al. | |
| 2013/0117932 | A1 * | 5/2013 | Stewart | A47C 19/025 5/400 |
| 2015/0305495 | A1 | 10/2015 | Tsai | |
| 2016/0174709 | A1 | 6/2016 | Ustach et al. | |
| 2016/0235192 | A1 | 8/2016 | Kramer et al. | |
| 2018/0014660 | A1 | 1/2018 | Iwata et al. | |
| 2018/0035821 | A1 | 2/2018 | Bass-Conn | |
| 2018/0049558 | A1 | 2/2018 | Jurcenko | |
| 2018/0125253 | A1 | 5/2018 | Choi | |

* cited by examiner

PROTECTIVE, COLLAPSIBLE, LIGHTWEIGHT BED FINISHING FRAME

CROSS-REFERENCE TO RELATED APPLICATIONS

This application is a continuation of application Ser. No. 15/173,857, filed Jun. 6, 2016, which claims the benefit of Provisional Application No. 62/230,437, filed Jun. 6, 2015, the disclosures of which are hereby incorporated by reference in their entirety.

FIELD OF THE PRESENT DISCLOSURE

This disclosure relates generally to bedroom furniture and bedding, and more particularly to a protective, highly padded/cushioned, lightweight, portable, collapsible, affordable, and aesthetically pleasing bed finishing frame apparatus.

BACKGROUND OF THE RELATED ART

The most classic style bed frames include a headboard and a footboard connected by rail boards and various cross members filming a structure to support a box spring, sometime called a foundation, a mattress. (For the purposes of this document "box spring" and "foundation" have the same definition meaning and the term "box spring" will be used for the remainder of this document.) While this style of bed frame is often desired, many individuals choose other options for a variety reasons. One of the most common reasons is safety. Classic style bed frames are often made of hard wood, metal, or some other structurally rigid material and often feature many unforgiving exposed edges, corners, and connective hardware upon which one could accidentally injure themselves.

Whether it be by accidentally kicking the leg of the footboard in the middle of the night while sleepily walking past the bed or banging or scraping one's shin against the rail board or exposed connective hardware when attempting to enter bed too quickly, almost everybody who has ever owned a classic style bed frame has accidentally injured themselves at one point or another and understands the unpleasantness of that experience. This is a particular concern for individuals that are accident prone, bruise easily, or have limited coordination.

The risk of injury from a classic style bed frame is also significant for children, both young and old. Children typically play on their bed and risk losing their balance or falling off and hitting or bumping themselves against a traditional rigid bard wood or metal bed frame. This is also true for the parents' own bed when children are in the house. Small children tend to be less coordinated and have a knack for injuring themselves in numerous and unpredictable ways, and older children tend to be more coordinated but are also more energetic and play more aggressively.

Some classic style bed frame designs have attempted to mitigate the risk of injury by including light padding along the head, foot and/or rail boards, however, beneath the thin padding there is always a very hard, rigid structural material that can prove to be painful if unintentionally impacted with enough force because the classic style bed frame is a load bearing structure and must be constructed from rigid materials.

There are other reasons individuals avoid the classic style bed frame as well. Such reasons include their typical weight and the assembly labor often required. Classic style bed frames are frequently made from substantial materials and require a fair amount of assembly effort, often times requiring tools, screws, bolts, and anchors. This also means that they must be dissembled to be moved. This process can be particularly burdensome for individuals who find themselves moving frequently, which is increasingly common in today's modern urban lifestyle. What's more, apart from the hassle of the assembly and disassembly process, classic style beds often do not break down into very small component parts making transportation during moves particularly awkward and burdensome, whether it be to another room in the same house or building or across town.

One common alternative is to use a box spring and mattress supported only by a simple collapsible metal frame with legs or casters. In some cases, to decorative headboard is attached to the metal frame to create the partial impression of a classic style bed, but it is not required as the metal frame typically provides all the structural support necessary for the box spring and mattress. A simple metal frame is often less expensive than a classic style bed frame and often requires considerably less effort to assemble and dissemble and may not even in require tools. It also weighs much less than a classic style bed which makes portability more convenient.

One major drawback of using only a simple metal frame is that they are not particularly attractive, and without rail boards there is nothing to obscure the box springs, which leaves the bed looking very unfinished and not aesthetically pleasing. Further, collapsible metal frames are very exposed, hard, and very uncomfortable if kicked or accidentally contacted otherwise. Likewise, the sides, corners, and edges of the box springs are not particularly soft may not be pleasant to contact unintentionally. Some individuals try to aesthetically obscure the bed's box spring and metal frame with as bed skirt, however, a bed skirt only obscures injury hazards, it does nothing to minimize them, and by obscuring injury hazards from view, bed skirts may even make injuries more likely. There exists a need for an aesthetically pleasing bed frame finishing option that also provides protective benefits.

Other individuals choose to forego using a bed frame all together and either place a box spring and mattress on a platform or directly on the ground. This option is usually chosen for its low cost and simplicity, however, this option lacks an aesthetically finished appearance. There exists a need for an aesthetically finished option that does not add significant cost or undue complexity.

The present disclosure distinguishes over the related art providing heretofore unknown advantages as described in the following summary.

BRIEF SUMMARY OF THE INVENTION

The present disclosure describes a highly padded and protective bed finishing frame apparatus designed to fit snugly over a box spring as a contour sheet that supports strategically placed padding situated in pocket chambers located along at least three of the four vertical sides of the box spring thereby creating an aesthetically pleasing and highly protective barrier around the external perimeter of the bed.

The padding provides the primary function of reducing or eliminating bumps, scrapes and/or stubbed toes that commonly result from getting in and out and moving around classic style bed frames that constructed from hard wood or metal. By providing a large, generous. soft protective layer around the box spring, the present disclosure generously covers any unforgiving edges and/or corners of the box spring and creates a cushioned/padded barrier far enough out from the perimeter of the box spring that any metal frame, platform, or other structure used to support the box spring that would otherwise present a toe stubbing hazard is sufficiently recessed and out of reach.

As a secondary benefit the present disclosure creates a very stylish and finished looking frame around the bed whether the mattress is situated on a box spring that is elevated by a simple metal frame, platform, or other structure, or is situated directly on the floor.

Further benefits include the fact that the presently described apparatus is collapsible and requires no assembly and can be easily folded into a relatively lightweight, reasonably sized box and shipped or transported, either by a purveyor after purchase or by its owner when moving, and then removed from the box and installed simply by skipping the device over the box spring without any tools or hassle.

For example of portability, one embodiment can be collapsed and placed into a box of Dimensions 35" L.times.20" W.times.12" H for all standard sized beds including but not limited to the following mattress and box spring sets:

Twin: 39' W.times.75" L; Full: 54" W.times.75" L; Queen: 60" W.times.80" L; California King: 72" W.times.84" L; Eastern King: 76" W.times.80" L. A single apparatus in a box weighs between twelve and thirty pounds and fits inside a standard car for transportation. These sizes are offered for example and are not intended to be limiting or restrictive. Other embodiments may require varying box sizes, however, generally, the presently disclosed apparatus can be folded into a reasonable sized and lightweight box making its portability a life-friendly advantage.

Regarding construction, most embodiments include a contour sheet that is sized Specifically to snugly slip over a particular sized box spring including the top and all four sides, at least three of which further include a pocket chamber sized to hold between one (1) and six (6) inches of padding along the entire length of the pocket chamber. A thickness of two and half (2.5) inches is often preferred in many style designs.

The pocket chambers are substantially similar in size to the sides of the industry standard box springs that the particular apparatus is design to fit. The phrase "substantially similar" in reference to size makes allowance for the moderate valiance necessary for style preferences and because the padding creates a large perimeter than the box spring and extends marginally further, and therefore, the pocket chamber must extend marginally further in length than the box spring. In many embodiments, the chamber pocket also extends marginally higher than the box spring as well to create the preferred stylistic appearance and ensure functional protection against injury by the hard upper edge of the box spring. These marginal differences all fall within the definition of substantially similar in size.

In most embodiments, the padding can be added or removed through an internally accessible resealable aperture. Some embodiments may be manufactured with the padding permanently encapsulated, however, a resealable aperture is preferred because when a resalable aperture is included in the embodiment design the padding can be removed and the remaining portion of the apparatus may by washed, providing yet another life-friendly benefit.

Different varieties of padding can be used, however, high density foam is an advantageous choice because of its protective nature and ability to take and hold a shape. Through the use of high density foam inserts, the padding can be shaped to add extra styling appeal to the apparatus. Two different preferred style shapes that have been discussed and illustrated in this specification are the "squared-style" and the "rounded-style." These terms refer to shape of the padding created by the shape of the high-density foam inserts.

The squared-style is created by using rectangular cuboid shaped high-density foam inserts and the rounded-style is created by using semicylinder shaped high-density foam inserts with the flat side facing inward toward the box spring when installed and the rounded edge facing outward away from the box spring when installed. For both of these two depicted styles, each terminal end of the high-density foam inserts may be shaped differently depending whether or not it will join the terminal end of another foam insert from another side of the box spring to form a corner. Each terminal end that is perpendicularly adjacent another is beveled at a forty-five (45) degree angle thereby forming a stylistically pleasing miter joint, whereas each terminal end that is not perpendicularly adjacent to another is cut straight forming a square terminal end. This is a style choice and can be adjusted accordingly as with the shape of the high density foam inserts. The presently disclosed apparatus can take on a wide variety of different stylistic embodiments. The styles illustrated are intended to be examples and are not intended to be limiting.

This disclosure teaches certain benefits in construction and use which give rise to the objectives described below.

A primary objective inherent in the above described method and apparatus is to provide advantages not taught by the prior art.

Another objective is to provide a highly protective and aesthetically pleasing bed finishing frame that is relatively affordable.

A further objective is to provide a highly protective and aesthetically pleasing bed finishing frame that requires no assembly.

A still further objective is to provide as highly protective and aesthetically pleasing bed finishing frame that is lightweight, collapsible, and convenient to transport.

A yet still further objective is to provide a highly protective and aesthetically pleasing bed finishing frame that is washable.

Other features and advantages of the present invention will become apparent from the following more detailed description, taken in conjunction with the accompanying drawings, which illustrate, by way of example, the principles and features of the presently described apparatus.

BRIEF DESCRIPTION OF THE SEVERAL VIEWS OF THE DRAWING(S)

The accompanying drawings illustrate various exemplary implementations and are part of the specification. The illustrated implementations are proffered for purposes of example not for purposes of limitation. Illustrated elements will be designated by numbers. Once designated, an element will be identified by the identical number throughout. Illustrated in the accompanying drawing(s) is at least one of the best embodiments of the present disclosure. In such drawing(s):

DETAILED DESCRIPTION THE EXEMPLARY EMBODIMENT

The above described drawing figures illustrate an exemplary embodiment of presently disclosed apparatus and its many features in at least one of its preferred, best mode embodiments, which is further defined in detail in the following description. Those having ordinary skill in the art may be able to make alterations and modifications to what is described herein without departing from its spirit and scope of the disclosure. Therefore, it must be understood that what is illustrated is set forth only for the purposes of example and that it should not be taken as a limitation in the scope of the present apparatus or its many features.

Described now in detail is a protective, highly padded/cushioned, lightweight, collapsible, portable, affordable, and aesthetically pleasing bed finishing frame.

Figure 1:
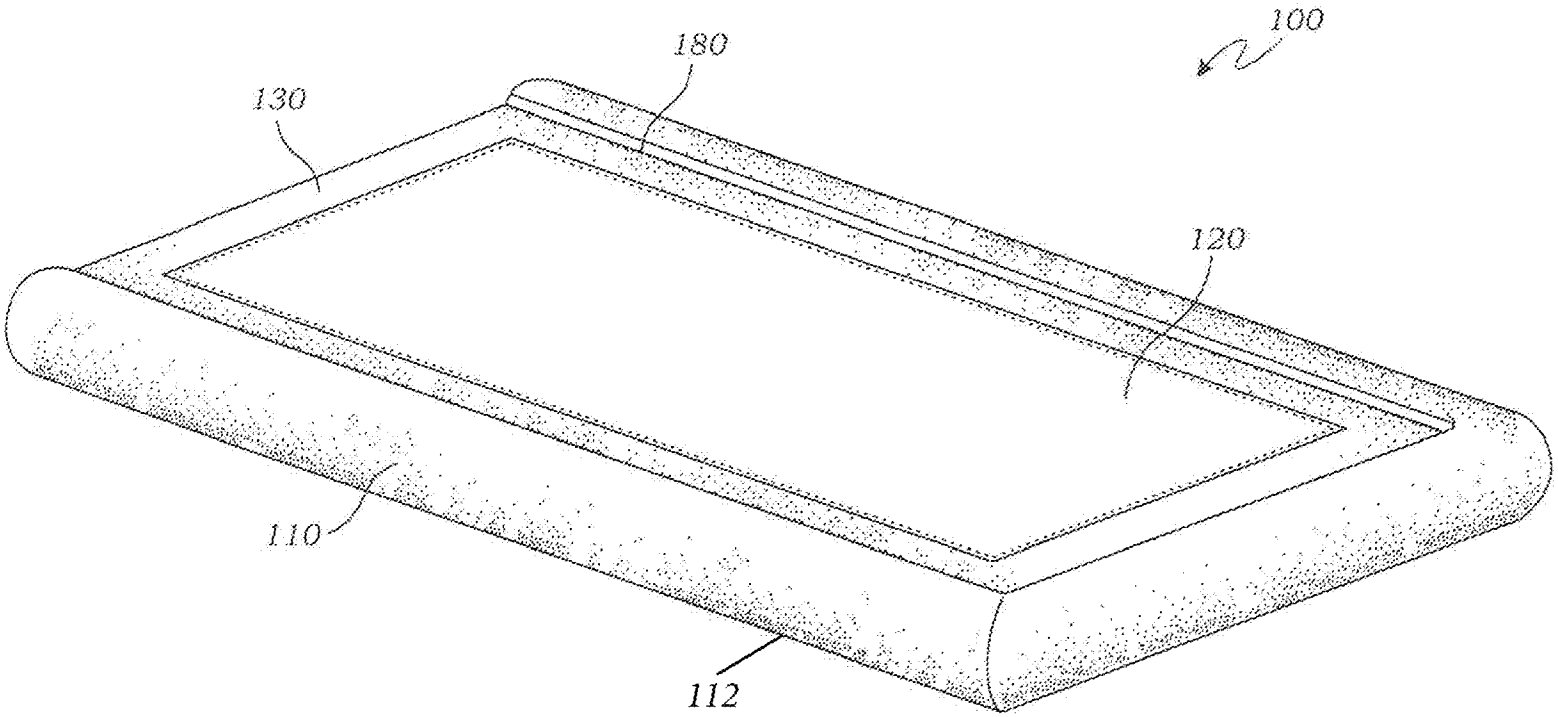
FIG. 1 is a perspective view of an exemplary rounded-style embodiment of the presently described apparatus.

FIG. 1 illustrates an exemplary rounded-style embodiment of the presently disclosed apparatus 100 fully expanded and ready to slip over a box spring to provide both physical protection in the form of the generous padding 110 along three sides and aesthetic finishing due to its unique and stylish design. The apparatus comprises a horizontal top 120 and four vertical sides forming a contour sheet that fits snugly over a box spring.

In the embodiment illustrated in FIG. 1, three of the four vertical sides contain pocket chambers capable of supporting padding. The aesthetically round shape of the rounded-style embodiment is created by both the shape of the pocket chamber as well as the shape of the internal padding itself. The illustration also shows as small vertical rise 180 between the beginning of the curvature of the horizontal top 120 and the curvature of the side 112. The purpose of this rise 180 is both a functional one ensuring that padding protects individuals from the hard upper edge of the box spring and stylistic providing the appropriate finishing appearance.

Through similar shading, FIG. 1 also illustrates that the trim 130 along the outside of the horizontal top 120 is of the same fabric variety and color of the vertical sides for aesthetic continuity. Whereas the center of the horizontal top 120 can be another color or quality of fabric.

Figure 2A:
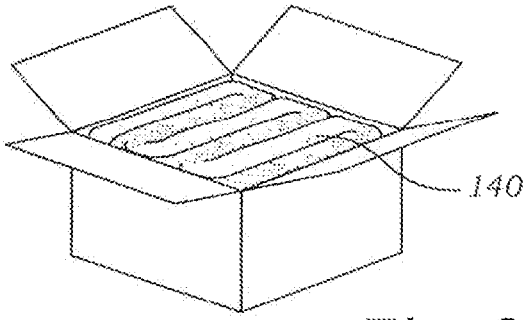
FIG. 2A is a perspective view of an exemplary embodiment of the presently described apparatus shown collapsed neatly in a relatively small box for shipping or transportation.

FIG. 2A is an illustration of the compact manner in which the presently disclosed apparatus can be neatly collapsed 140 into a reasonably sized box. This allows both purveyors the ability to ship the product via standard parcel carriers and for owners to pack and move the apparatus without excessive stress or strain.

Figure 2B:
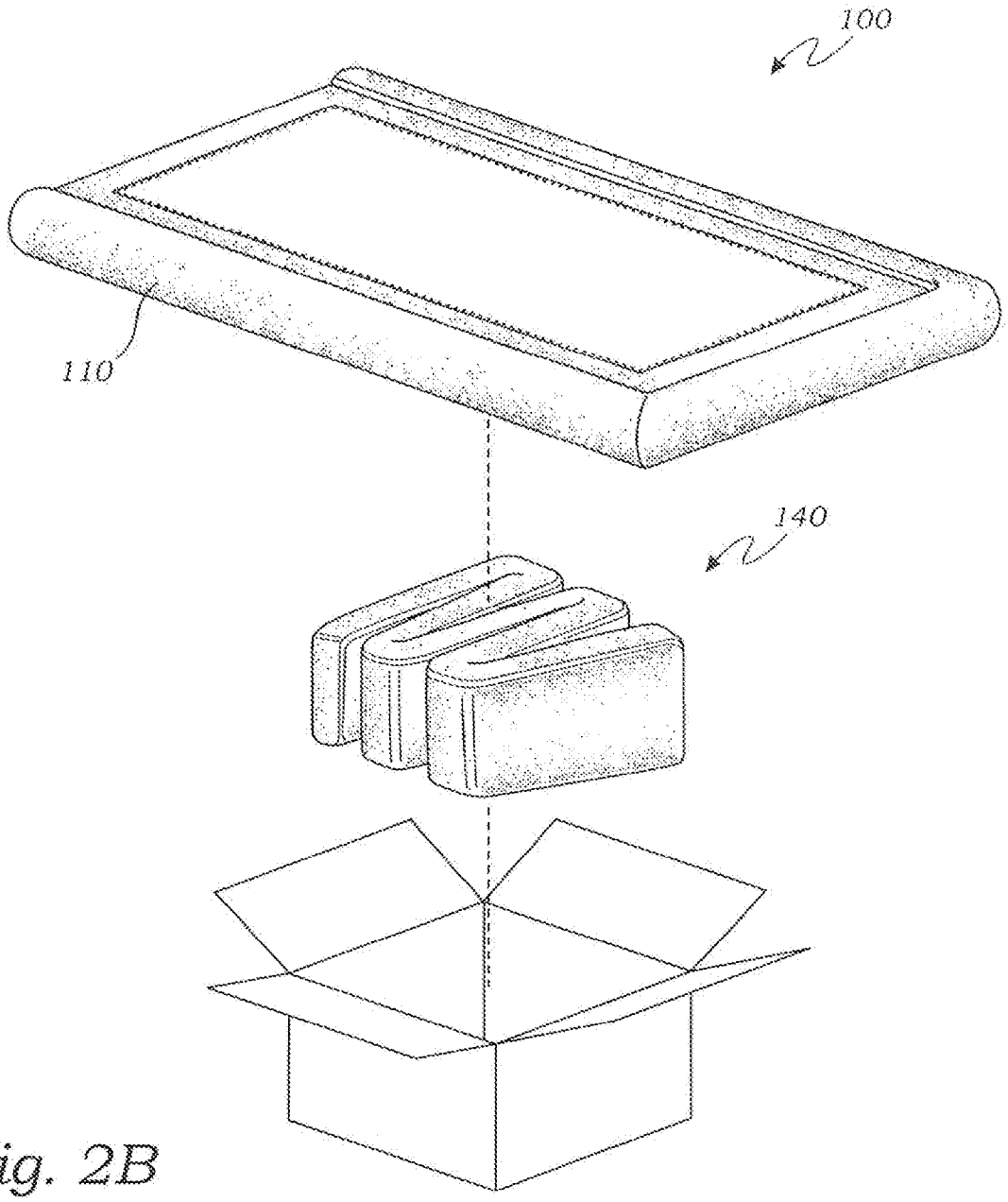
FIG. 2B is a blown up view of an exemplary embodiment of the presently described apparatus depicting the apparatus being removed from a collapsed stated in a relatively small box and unfolding it to a ready it to install state without any assembly required.

FIG. 2B illustrates an exploded view of the presently disclosed apparatus being removed from a reasonable sized box neatly collapsed 140 and expanded into a fully assembled apparatus ready for installation 100. There are no tools or assembly steps required between opening the box in which the apparatus is shipped, removal, expansion and installation.

Figure 3:
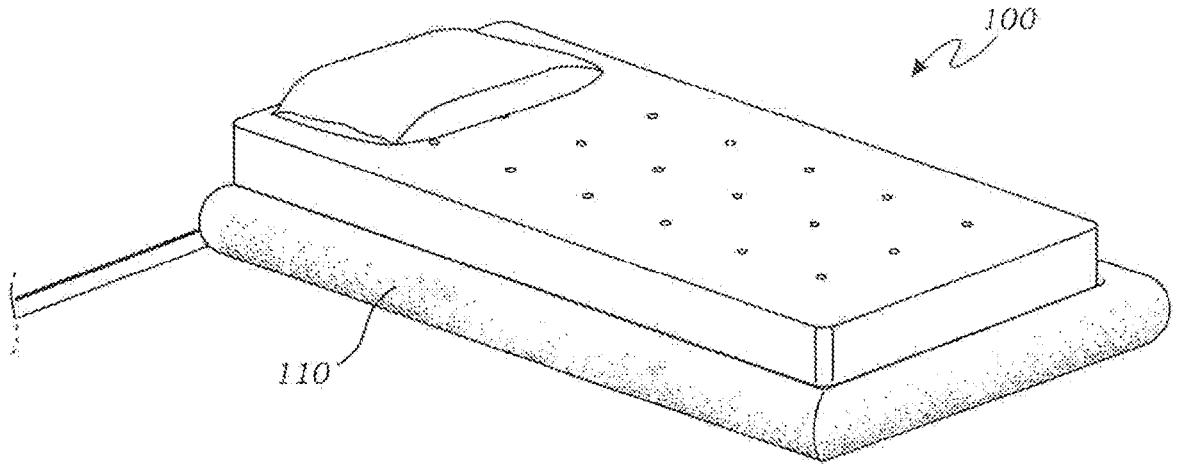
FIG. 3 is a perspective view of an exemplary rounded-style embodiment of the presently described apparatus shown installed over a box spring located directly on the floor and beneath a mattress and pillow.

FIG. 3 illustrates the rounded-style embodiment of the presently disclosed apparatus 100 installed on a box spring that is resting on the floor and supporting a mattress. This illustration depicts the aesthetically finished look that the presently disclosed apparatus created even with a simple box spring and mattress resting on the floor without a bedframe. FIG. 3 also depicts the visually seamless transition that is assisted by the small riser 180 identified in FIG. 1.

Figure 4:
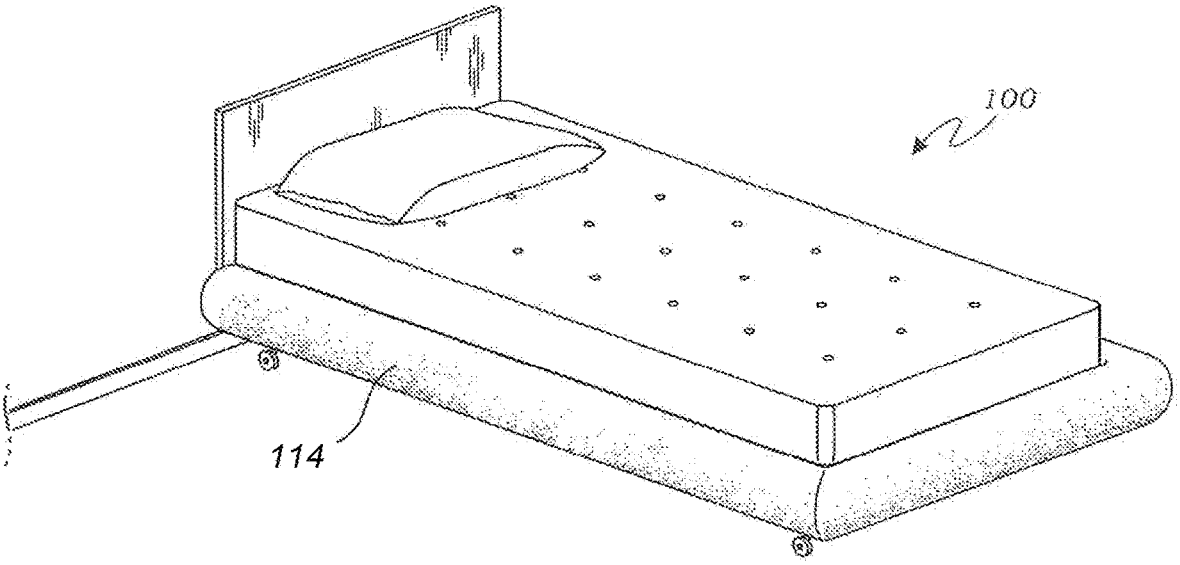
FIG. 4 is a perspective view of an exemplary rounded-style embodiment of the presently described apparatus shown installed over a box spring supported by a metal frame on casters and beneath a mattress and pillow, it also shows that the apparatus can be used with a decorative headboard.

FIG. 4 is an illustration of the same rounded-style embodiment of the presently disclosed apparatus 100 installed on a box spring that is resting on a simple metal frame on casters with a stylistic headboard. The metal frame raises the apparatus off the floor compared to the illustration in FIG. 3 creating a gap between the curved vertical side 114 and the floor, however, because the curved, vertical side 114 protrudes outward from the assembled bed, the risk of accidentally kicking a caster while walking by the bed is greatly reduced.

Figure 5:
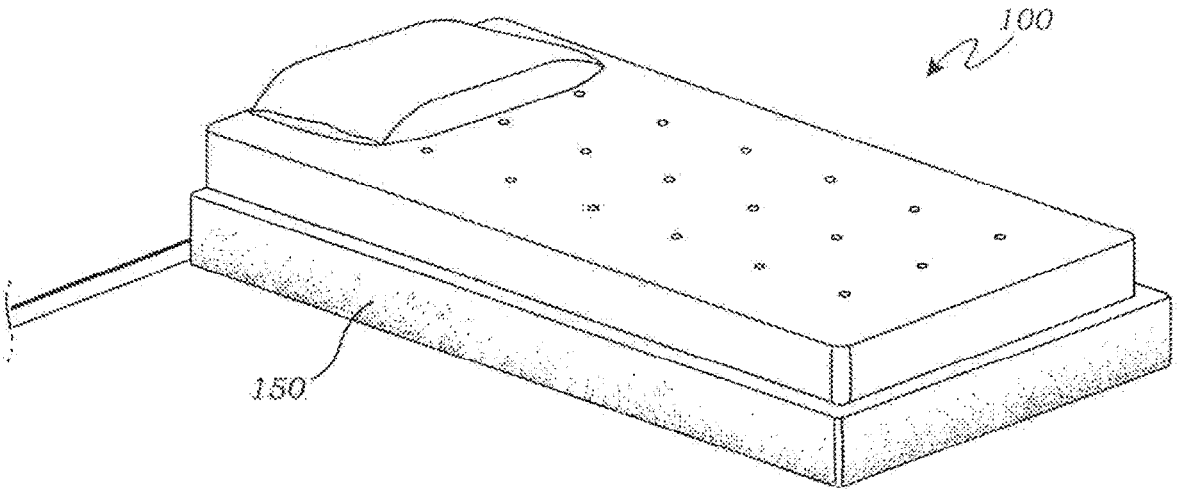
FIG. 5 is a perspective view of an exemplary squared-style embodiment of the presently described apparatus shown installed over a box spring located directly on the floor and beneath a mattress and pillow.

FIG. 5 is an illustration of the squared-style embodiment of the presently disclosed apparatus 100 installed over a box spring that is resting directly on the floor. Very similar to the rounded-style embodiment, the squared-style embodiment both creates an aesthetically pleasing finish on the box spring-mattress assembly and provides a generously cushioned protective barrier 150 between the unpleasantly hard edges of the box spring and the individual.

Figure 6:
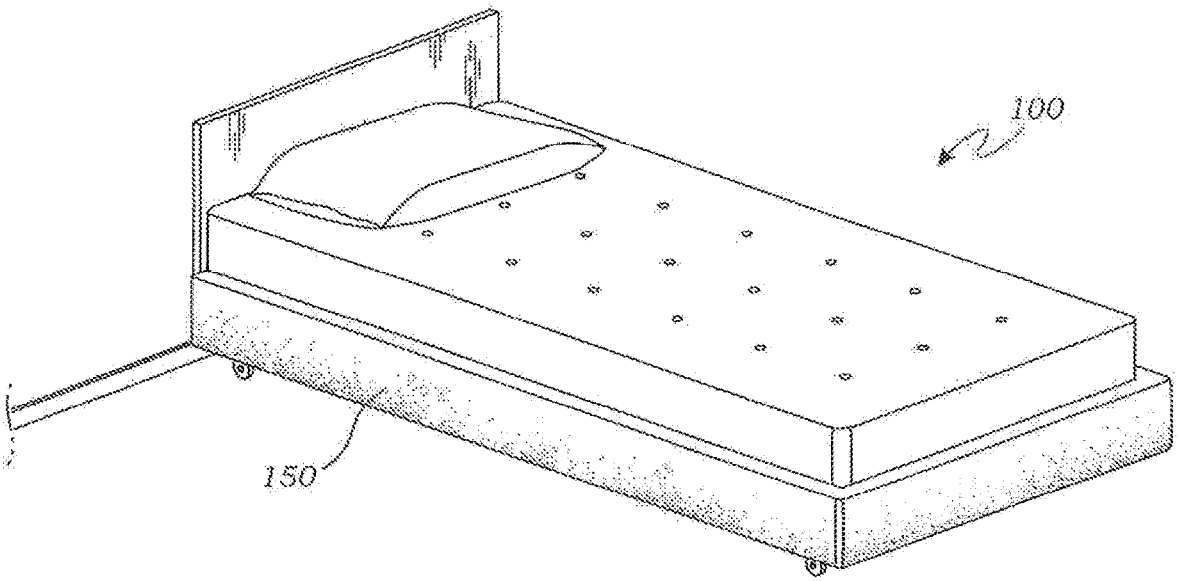
FIG. 6 is a perspective view of an exemplary squared-style embodiment of the presently described apparatus shown installed over a box spring supported by a metal frame on castors and beneath a mattress and pillow with a decorative headboard.

Likewise, FIG. 6 depicts the squared-style version of the presently disclosed apparatus 100 installed on a box spring that is supported by a simple metal frame on casters. Again, as with the rounded-style embodiment 100, FIG. 6 illustrates how the riser depicted 180 assists in the seamless integration between the box spring and mattress.

Figure 7:
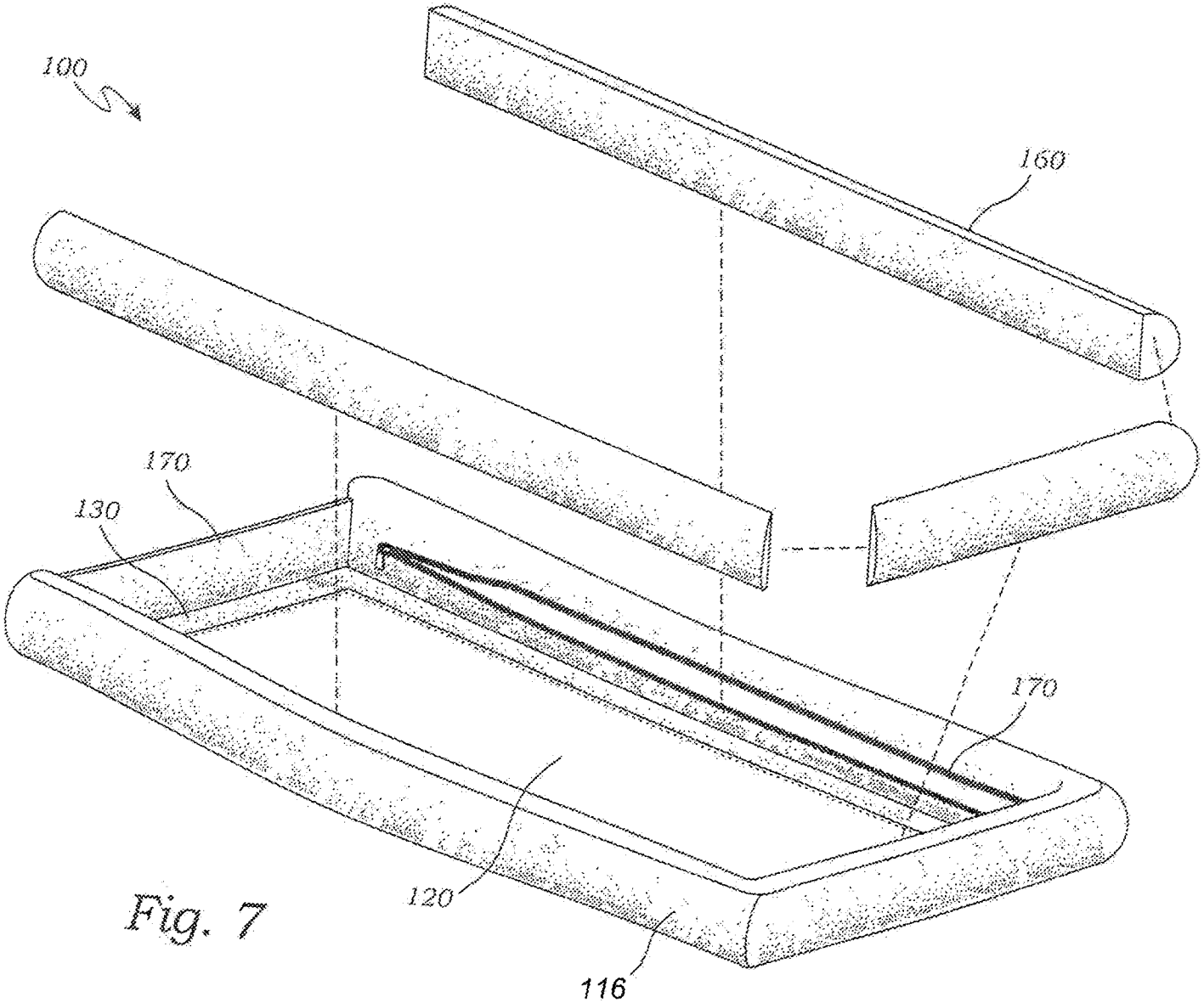
FIG. 7 is an exploded bottom perspective view of an exemplary rounded-style embodiment illustrating the semi-cylinder shaped high density foam insert and the resealable insertion aperture.

FIG. 7 is a bottom view a rounded-style embodiment illustrating that the rounded shape 116 is created in part by the semicylinder shaped high density foam inserts 160. High density foam inserts 160 are a preferred form of padding because it is very protective and is shapeable. It also hold its shape well over time. In other embodiments, shapeless padding such as cotton may be used. In such embodiments, the external shape of the apparatus may be determined more by the shape of the pocket chamber than by the shape of the padding.

FIG. 7 also illustrates that the padding 160 can be removed through a zipper 170 along the internal side. This is an important feature because it allows and individual to remove the padding 160 and wash the apparatus. While not all embodiments feature zippers 170, most embodiments feature a resealable aperture 170 of some variety. Embodiment with such a feature must be washed more carefully by hand without removing the padding.

FIG. 7 also depicts the vertical side 170 that does not include a pocket chamber. Vertical sides 170 that do not include a pocket chamber are import because they assist the apparatus fit snugly on the box spring. The preferred embodiment of the presently disclosed apparatus 100 include three chamber pockets, however, some embodiments include chamber pockets in all four vertical sides or in less than three vertical sides.

Figure 8:
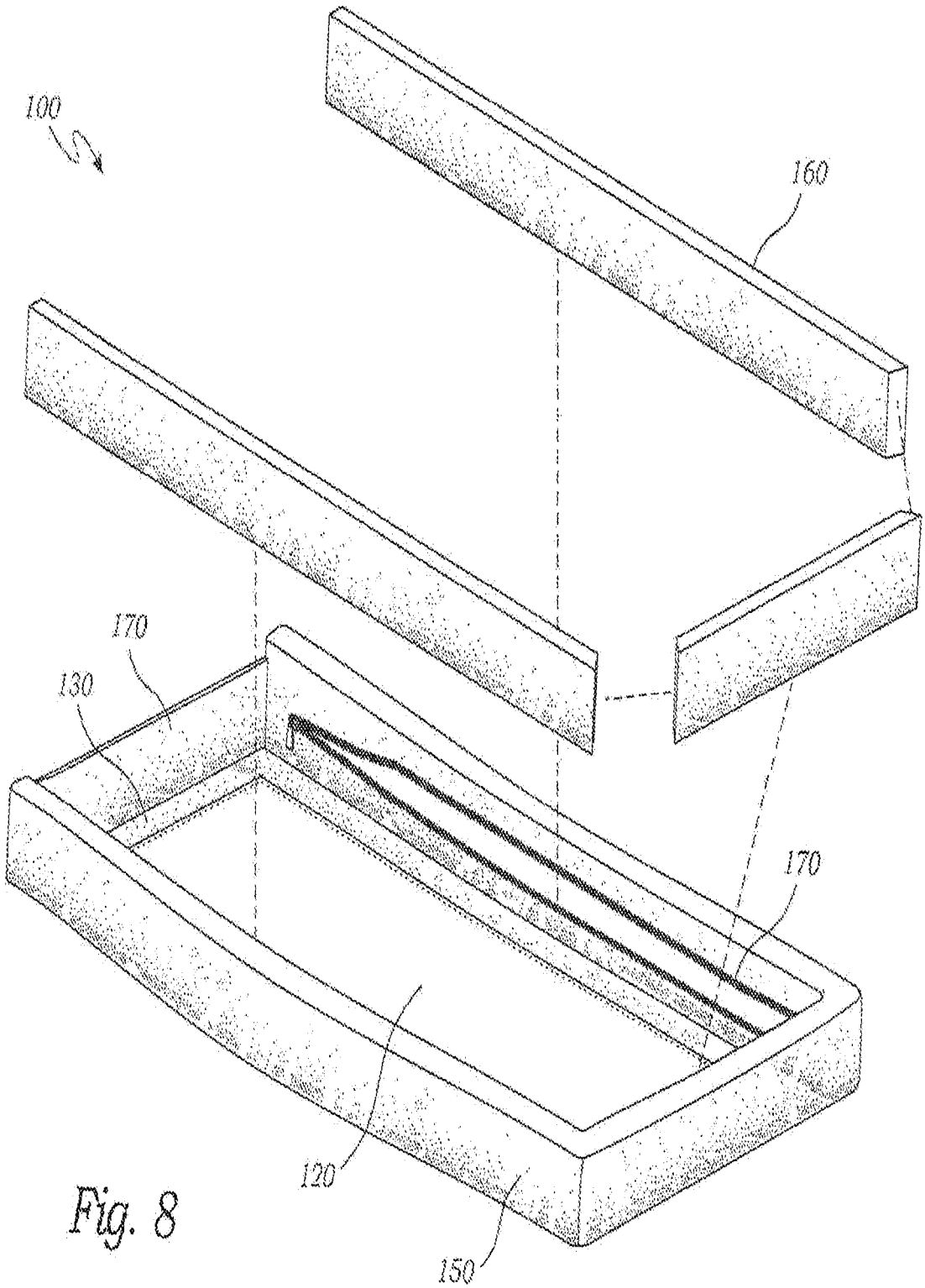
FIG. 8 is an exploded bottom perspective view of an exemplary squared-style embodiment illustrating the rectangular cuboid shaped high density foam insert and the resealable insertion aperture.

FIG. 8 illustrates a bottom view of a squared-style embodiment and the rectangular cuboidal high-density foam inserts 160 that assist in creating the squared appearance 150. FIG. 8 and FIG. 7 also illustrate the forty-five degree beveled terminal ends of the foam inserts that join to form a ninety degree miter joint. In embodiments in which the padding 160 is shapeless soft padding such defined ninety degree corners are more difficult to achieve.

Figure 9:
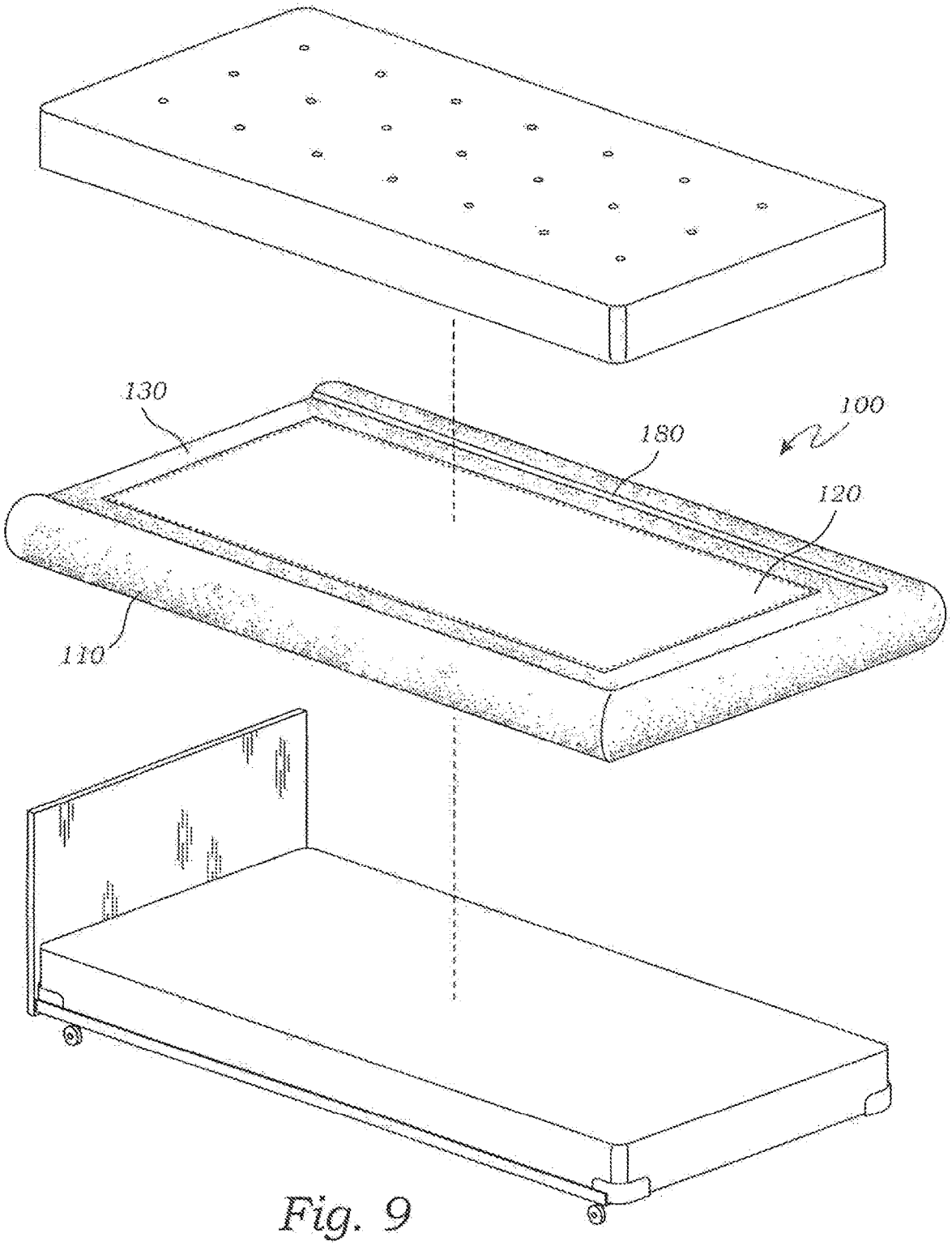
FIG. 9 is an exploded perspective view of an exemplary round-style embodiment of the presently described apparatus shown installed over a box spring supported by a metal frame on casters and beneath a mattress.

FIG. 9 illustrates an exploded view of a rounded-style embodiment of the presently disclosed apparatus 100 and a box spring supported by a simple metal frame on casters with a decorative headboard. It is very apparent from the exploded view that the metal frame on caster is a significant toe stubbing risk and is not aesthetically attractive at all.

Figure 10:
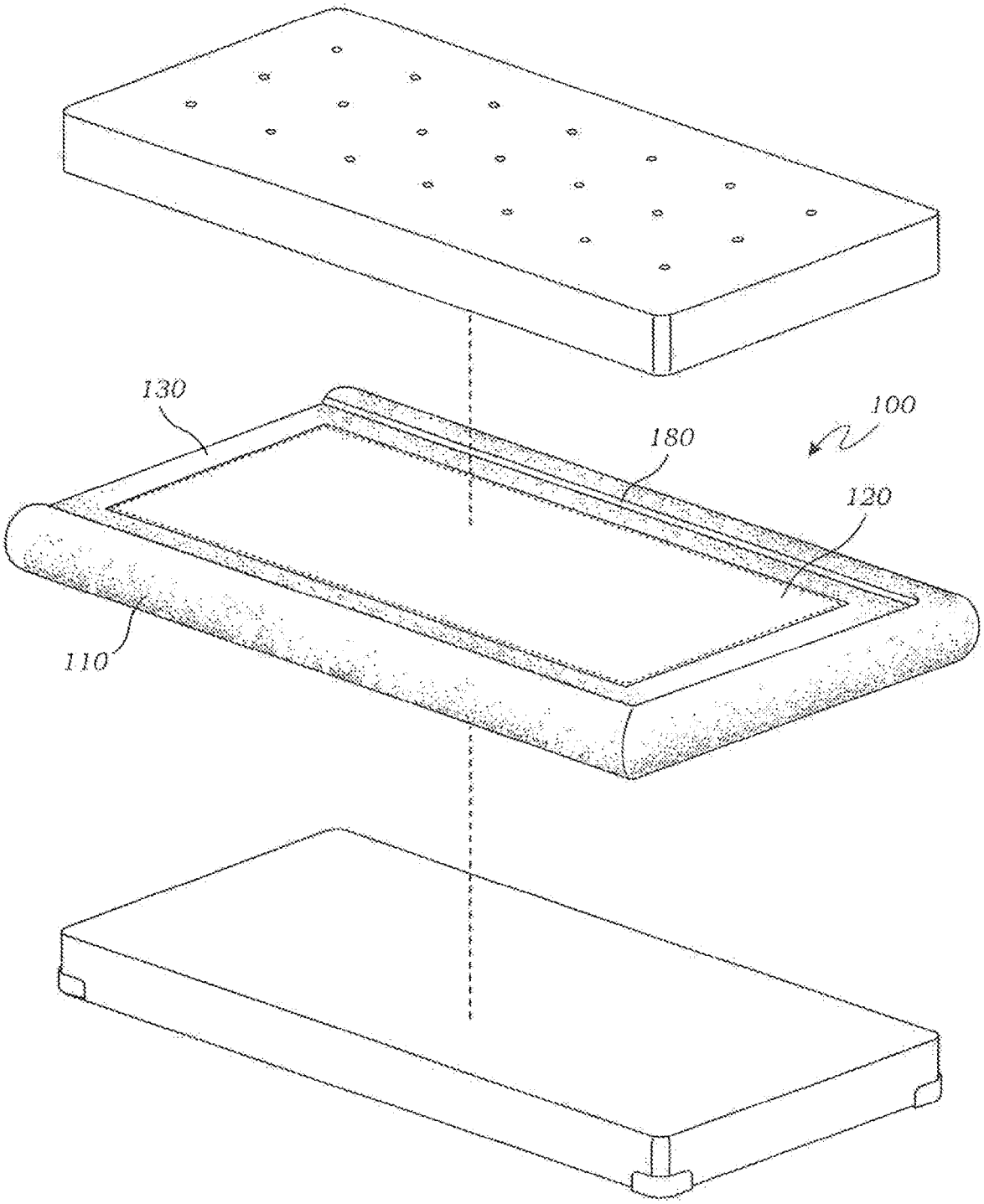
FIG. 10 is an exploded perspective view of an exemplary rounded-style embodiment of the presently described apparatus shown installed over a box spring located directly on the floor beneath a mattress with a decorative headboard.
Figure 11:
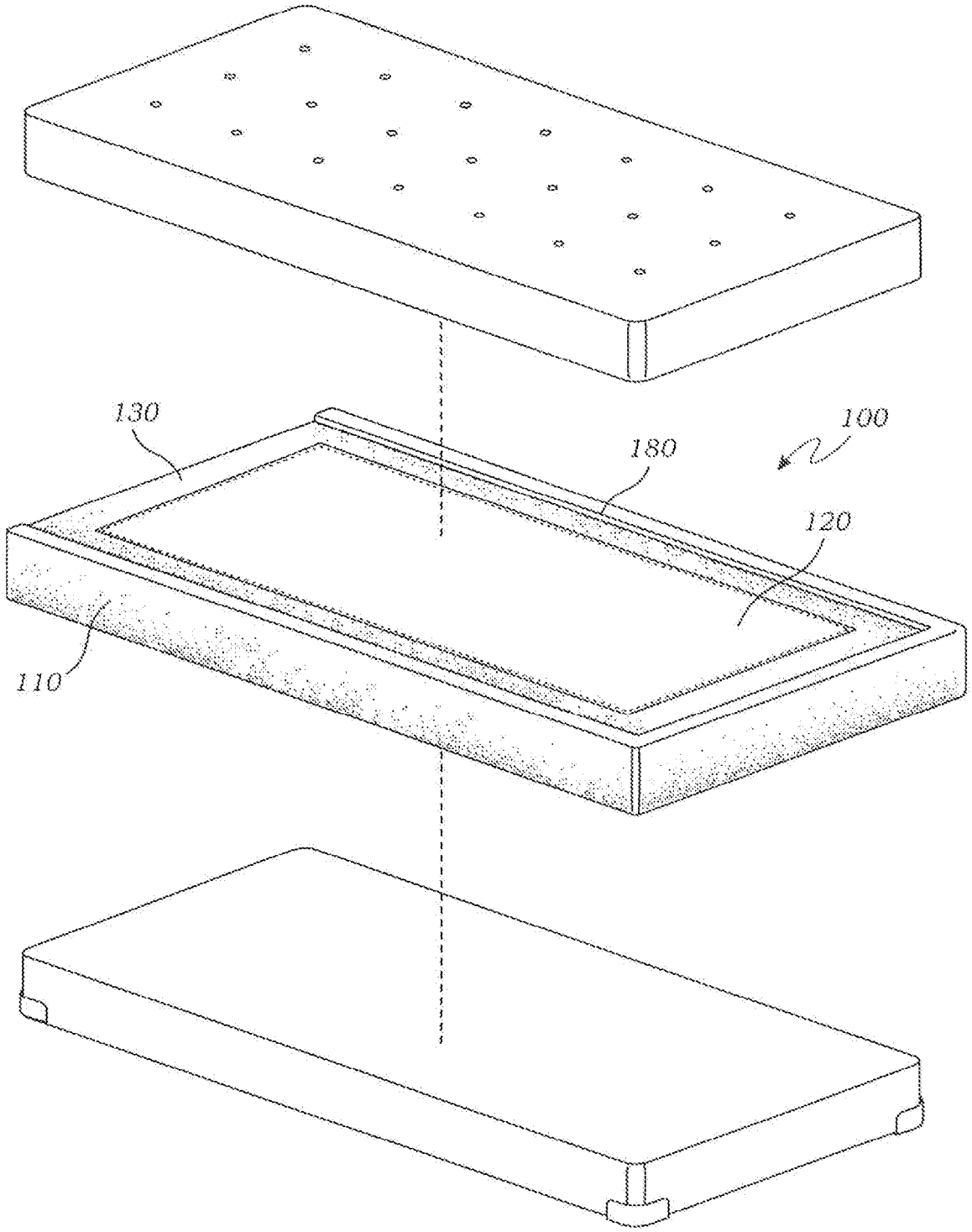
FIG. 11 is an exploded perspective view of an exemplary squared style embodiment of the presently described apparatus shown installed over a box spring located directly on the floor beneath a mattress.

Similarly, FIG. 10 and FIG. 11 illustrate exploded views of a rounded-style and a squared style embodiment of the presently disclosed apparatus, respectively, being placed over a box spring that are located directly on the floor showing both the ease of installment and the relative protection and aesthetic style the presently disclosed apparatus 100 provides.

Figure 12:
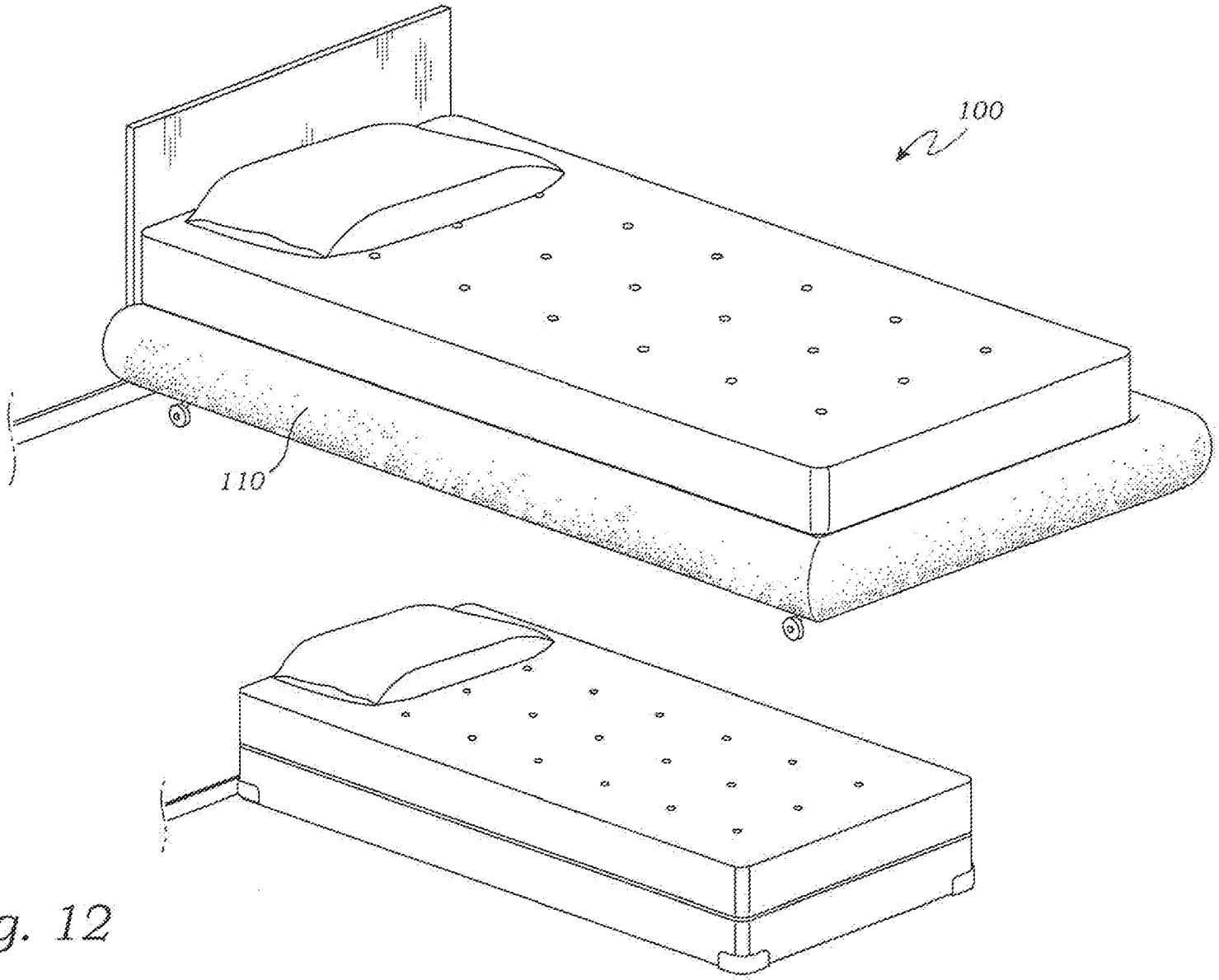
FIG. 12 is a side-by-side comparison view of an exemplary round-style embodiment of the presently described apparatus shown installed over a box spring supported by a metal frame on casters and beneath a mattress with a decorative headboard and the most comparable prior art which is a mattress resting on a box spring, looking very unfinished.
Figure 13:
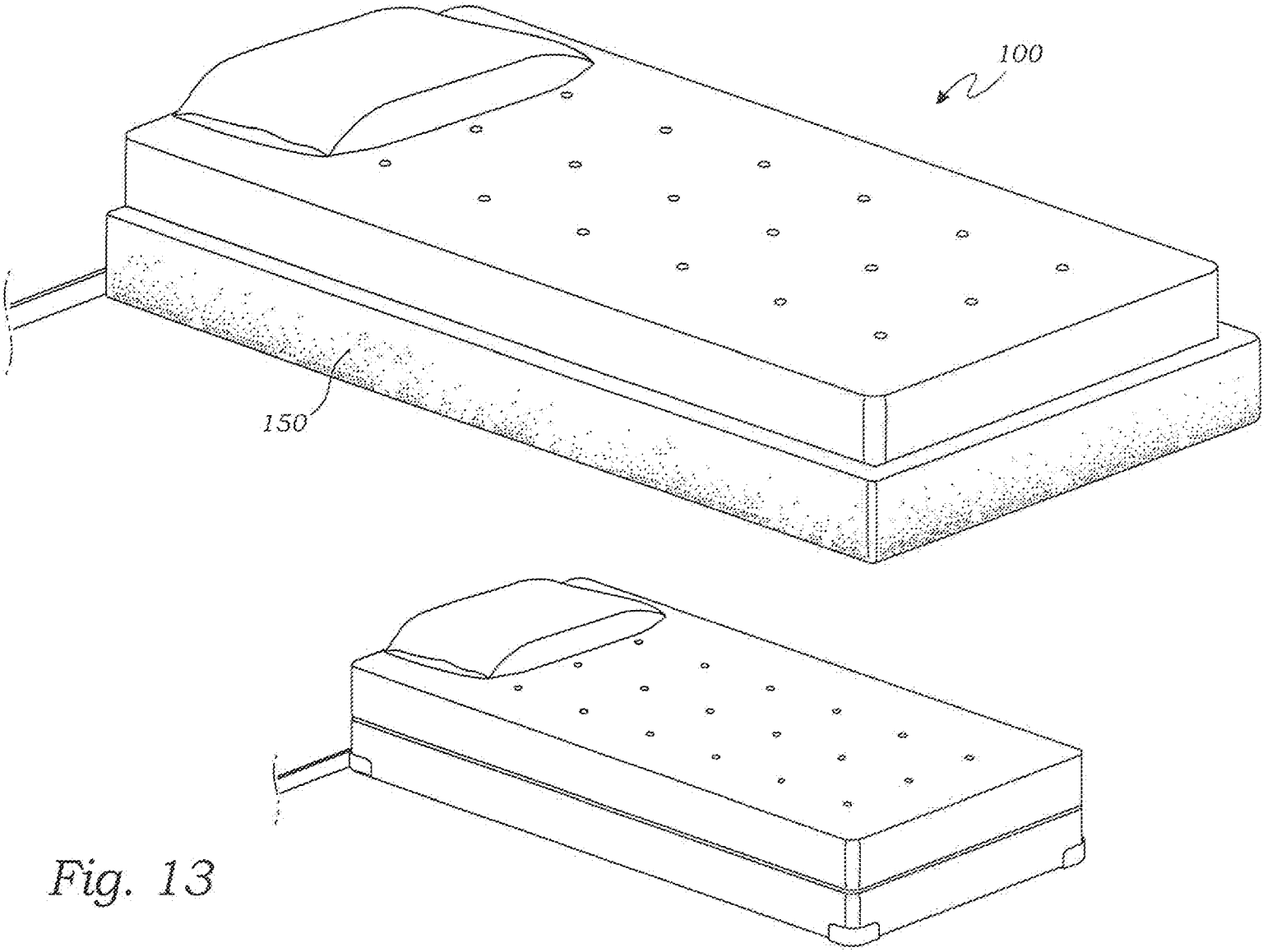
FIG. 13 is a side-by-side comparison view of an exemplary squared-style embodiment of the presently described apparatus shown installed over a box spring located directly on the ground and the most comparable prior art which is a mattress resting on a box spring located directly on the ground looking very unfinished.

FIG. 12 and FIG. 13 provides a side-by-side comparisons of a round-style embodiment 100 on a box spring supported by a metal frame and a squared-style embodiment 100 on a box spring situated on the floor, each next to the comparable prior art. Such a side-by-side comparison demonstrate the vast difference in aesthetic finish the presently disclosed apparatus provides of the prior art.

Figure 14:
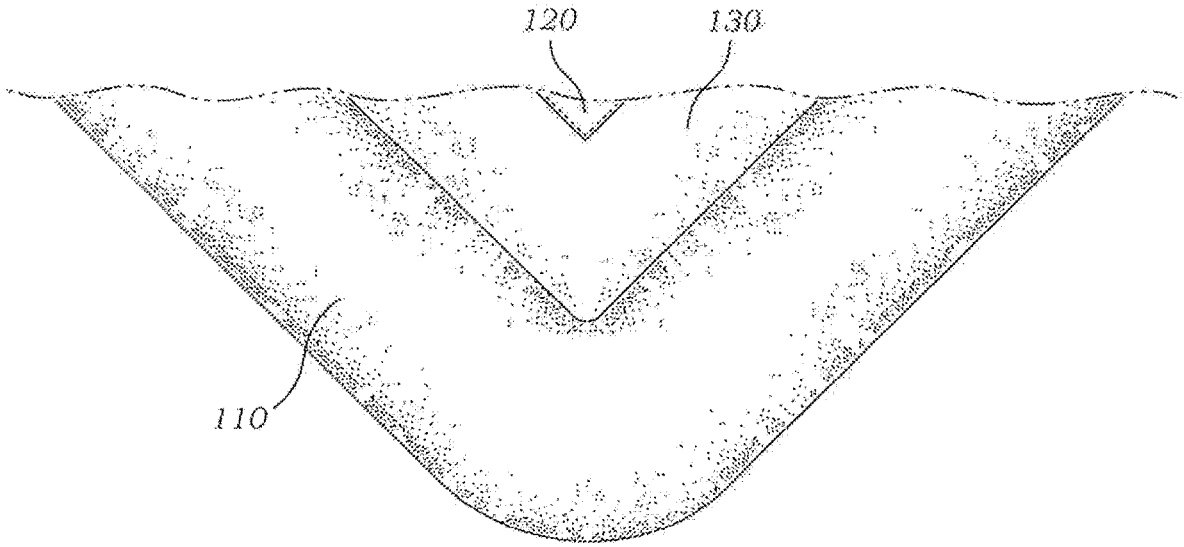
FIG. 14 is a breakout top view of a corner junction on an exemplary rounded-style embodiment of the presently described apparatus.
Figure 15:
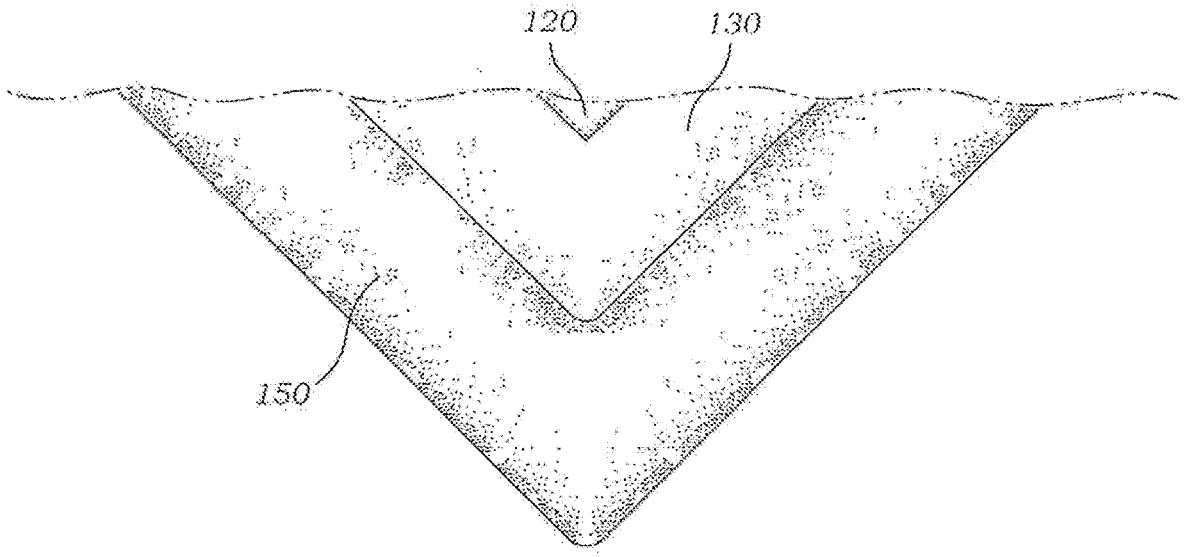
FIG. 15 is a breakout top view of a corner junction on an exemplary squared-style embodiment of the presently described apparatus.

FIGS. 14 and 15 illustrate breakaway close up views of the rounded-style and squared-style corners, respectively. The clean lines and well defined corners are made possible by the beveled terminal ends of the foam inserts.

Figure 16:
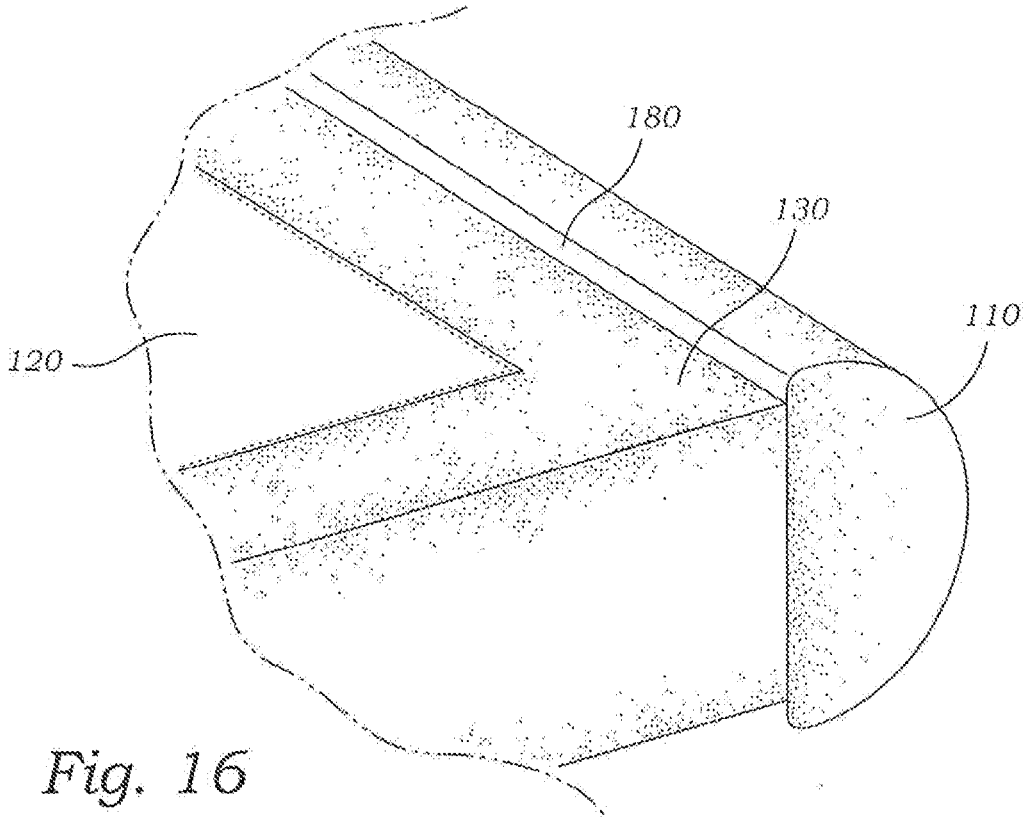
FIG. 16 is a breakout perspective view of the straight cut end of the foam insert of an exemplary rounded-style embodiment of the presently described apparatus.
Figure 17:
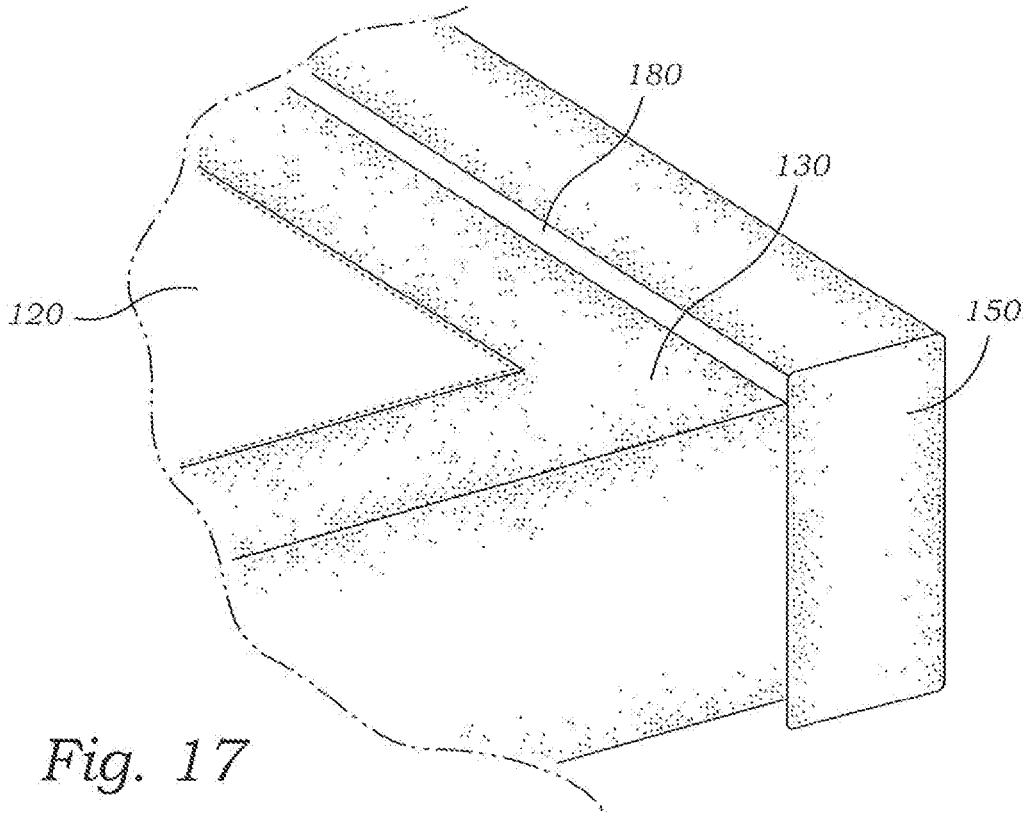
FIG. 17 is a breakout perspective view the straight cut end of the foam insert of an exemplary squared-style embodiment of the presently described apparatus.

FIGS. 16 and 17 illustrate breakaway close up views of the straight cut ends of the foam inserts 160 when the padded side is perpendicularly adjacent as non-padded side. These breakaway view also depict the small riser 180 between the vertical side and the pocket chamber that exist for both stylistic and protective functional reasons.

The enablements described in detail above are considered novel over the prior art of record and are considered critical to the operation of at least one aspect of the apparatus and its method of use, and to the achievement of the above-described objectives. The words used in this specification to describe the instant embodiments are to be understood not only in the sense of their commonly defined meanings, but to include by special definition in this specification: structure, material, or acts beyond the scope of the commonly defined meanings. Thus, if an element can be understood in the context of this specification as including more than one meaning, then its use must be understood as being generic to all possible meanings supported by the specification and by the word(s) describing the element.

The definitions of the words or drawing elements described herein are meant to include not only the combination of elements, which are literally set forth, but all equivalent structures, materials or arts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, substitutions, now or later known to one with ordinary skill in the art, are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A contour sheet that fits over a top side of a box spring comprising:

a top sheet portion configured to extend across a top portion of the box spring; and a plurality of vertical side sheet portions configured to extend, from a perimeter of the top sheet portion, in a perpendicular direction to surround the box spring, wherein the plurality of vertical side sheet portions includes three vertical side sheet portions extending in the perpendicular directions from different sides of the top sheet portion, the three vertical side sheet portions including respective pocket chambers for retaining respective volumes of padding, each pocket chamber extending a respective distance of a respective one of the three vertical side sheet portions, wherein the plurality of vertical side sheet portions includes a fourth vertical side sheet portion that does not include a pocket chamber, wherein each pocket chamber is accessible via an opening on a side of the pocket chamber proximate to the box spring to enable removal of the respective volume of padding through the opening, and at least one vertical exterior edge of the box spring is entirely covered by at least one of the respective volumes of padding where two sides of the box spring meet when the top sheet portion is positioned on the top portion of the box spring.

2. The contour sheet of claim 1, wherein:

each of the respective volumes of padding has a first side adjacent to a side of the top sheet portion, one of the respective volumes of padding has terminal ends that are beveled at forty-five degrees from the first side, and two of the respective volumes of padding have a first terminal end that is beveled at forty-five degrees from the first side and second terminal ends that are perpendicular to the first side.

3. The contour sheet of claim 1, further comprising a trim around outer edges of the top sheet portion.

4. The contour sheet of claim 3, wherein the trim extends from the outer edges of the top sheet portion from the three vertical side sheet portions.

5. The contour sheet of claim 3, wherein the trim is a different material or a different color from the top sheet portion.

6. The contour sheet of claim 3, wherein a color of the trim matches a color of the plurality of vertical side sheet portions.

7. The contour sheet of claim 3, wherein a material of the trim matches a material of the plurality of vertical side sheet portions.

8. The contour sheet of claim 1, wherein each of the three vertical side sheet portions having the pocket chambers includes a rise that extends in a direction opposite to the perpendicular direction in which plurality of vertical side sheet portions extend.

9. A contour sheet that fits over a top side of a box spring comprising:

a first portion configured to extend across a top portion of the box spring; and vertical side sheet portions configured to extend, from a perimeter of the first portion, in a perpendicular direction, to surround the box spring, wherein each of three vertical side sheet portions of the vertical side sheet portions includes a pocket chamber extending a respective distance of a respective vertical side sheet portion of the three vertical side sheet portions, and a fourth vertical side sheet portion of the vertical side sheet portions does not include a pocket chamber, wherein the pocket chambers retaining respective volumes of padding, wherein each pocket chamber is accessible via an opening on a side of the pocket chamber proximate to the box spring to enable removal of the respective volume of padding through the opening, and wherein at least one of the volumes of padding fully covers at least one vertical exterior edge of the box spring where two sides of the box spring meet when the first portion is positioned on the top portion of the box spring.

10. The contour sheet of claim 9, wherein the pocket chamber for each of the three vertical side sheet portions extends through each of the three vertical side sheet portions.

11. The contour sheet of claim 10, wherein each volume of padding corresponds to a respective one of the three vertical side sheet portions.

12. The contour sheet of claim 11, wherein:

each volume has a first side adjacent to a side of the first portion, one of the respective volumes of padding has terminal ends that are beveled at forty-five degrees from the first side, and two of the respective volumes of padding have a first terminal end that is beveled at forty-five degrees from the first side and second terminal ends that are perpendicular to the first side.

13. The contour sheet of claim 9, further comprising a trim around outer edges of the first portion.

14. The contour sheet of claim 13, wherein the trim extends from the outer edges of the first portion from the three vertical side sheet portions.

15. The contour sheet of claim 13, wherein the trim is a different material or a different color from the first portion.

16. The contour sheet of claim 13, wherein a color and a material of the trim matches a color and a material of the vertical side sheet portions.

17. The contour sheet of claim 9, wherein the three vertical side sheet portions having the pocket chambers includes a rise that extends in a direction opposite to the perpendicular direction in which the vertical side sheet portions extend.

* * * * *